United States Patent [19]

Galli

[11] 4,305,415

[45] Dec. 15, 1981

[54] MOTOR VEHICLE HOUSING

[76] Inventor: Joseph Galli, 15 Williamsburg Ter., Pittsfield, Mass. 01201

[21] Appl. No.: 169,289

[22] Filed: Jul. 16, 1980

[51] Int. Cl.[3] ..... A45F 1/16

[52] U.S. Cl. ..... 135/3 A; 135/7.1 R

[58] Field of Search ..... 135/1 A, 3 A, 4 A, 5 A, 135/7.1 A; 52/63, 64; 160/19-22, 29

[56] References Cited

U.S. PATENT DOCUMENTS

| | | | |
|---|---|---|---|
| 1,737,664 | 12/1929 | Maness | 135/7.1 A |
| 2,956,573 | 10/1960 | Brown | 135/7.1 A |
| 3,097,014 | 7/1963 | Francis | 135/7.1 A |
| 3,463,174 | 8/1969 | Heller | 135/5 A X |
| 3,870,061 | 3/1975 | Lowery | 135/7.1 A X |
| 4,228,622 | 10/1980 | Tisma | 52/63 |

FOREIGN PATENT DOCUMENTS

| | | | |
|---|---|---|---|
| 864958 | 4/1961 | United Kingdom | 52/63 |

*Primary Examiner*—J. Karl Bell

*Attorney, Agent, or Firm*—Chapin, Neal & Dempsey

[57] ABSTRACT

A housing is disclosed for shielding portions of a motor vehicle from weather conditions. The housing includes a frame which is adjustable in size and which, in the preferred embodiment, is adapted to shelter the hood portion of an automobile. In another embodiment, the frame includes a section that is adapted also to protect the windshield portion of the automobile.

5 Claims, 6 Drawing Figures

Fig. 1.
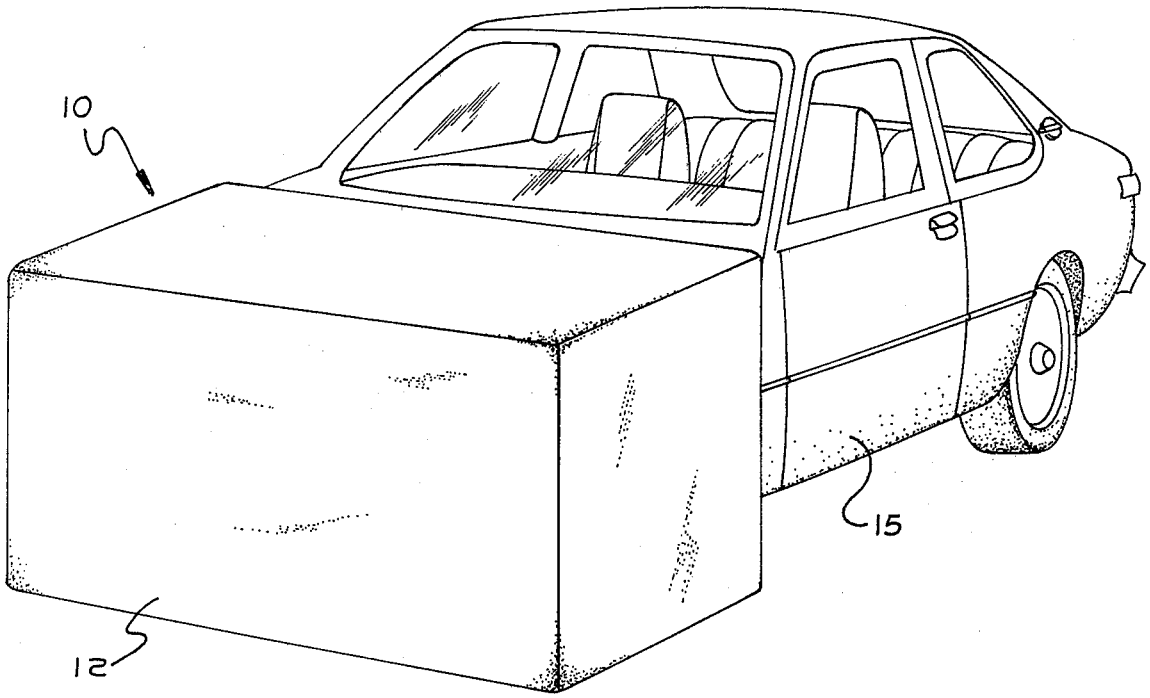
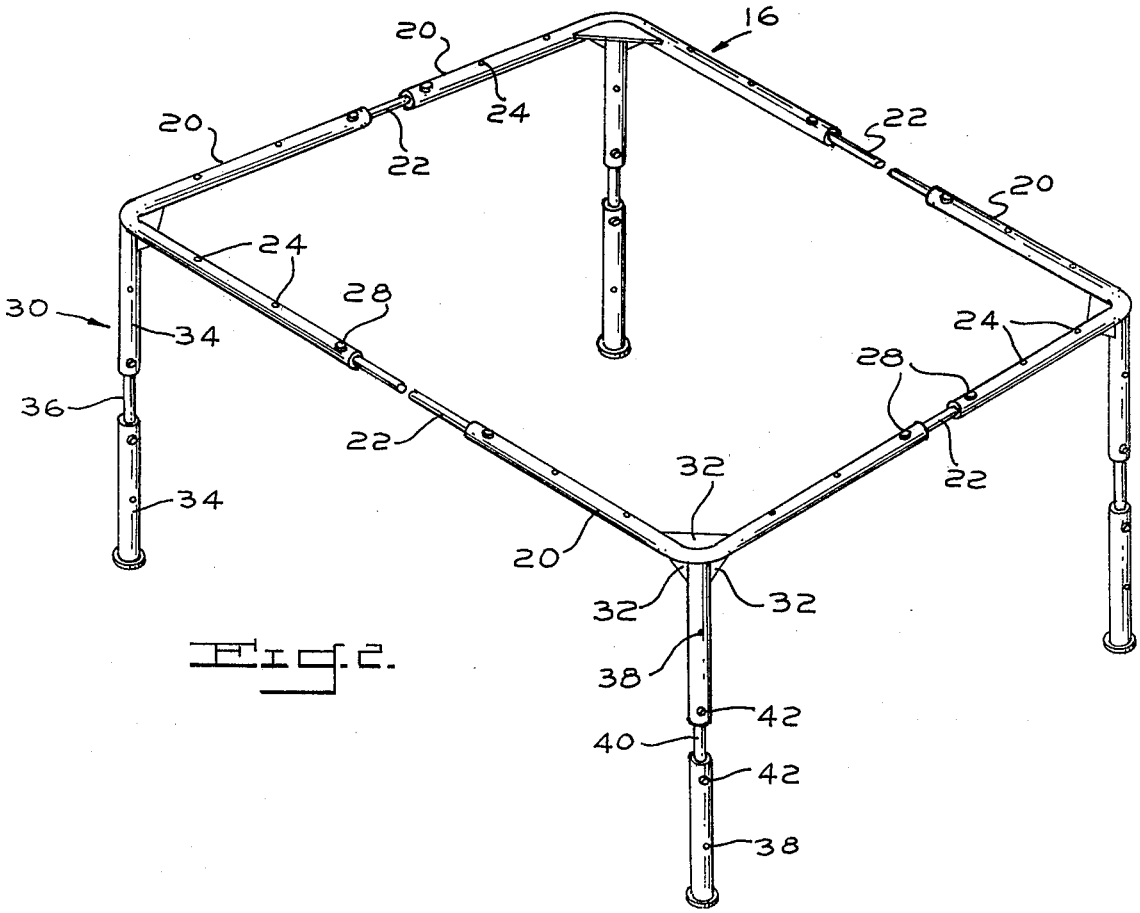
Fig. 2.

Fig. 3.
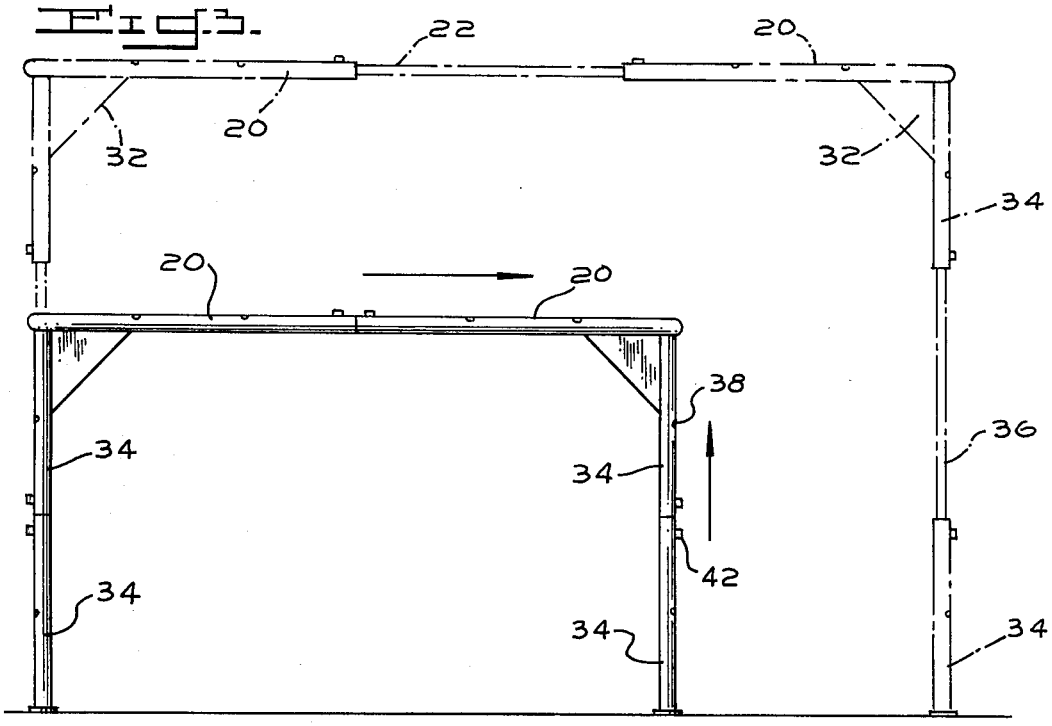
Fig. 4.
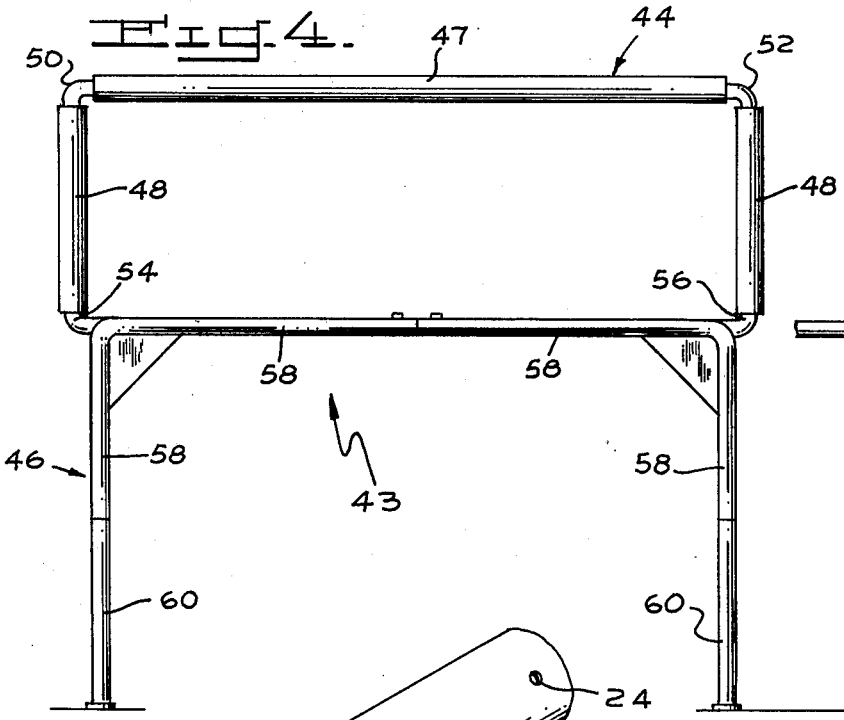
Fig. 5.
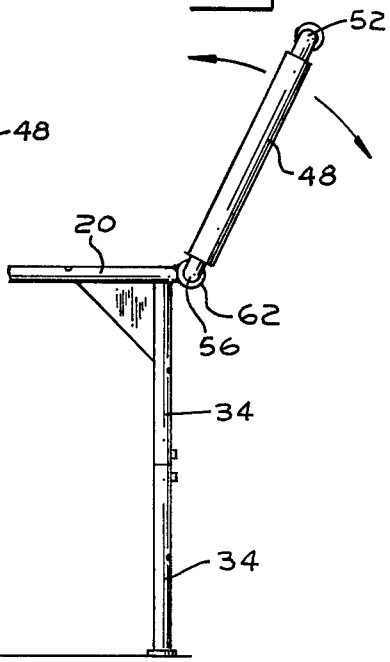
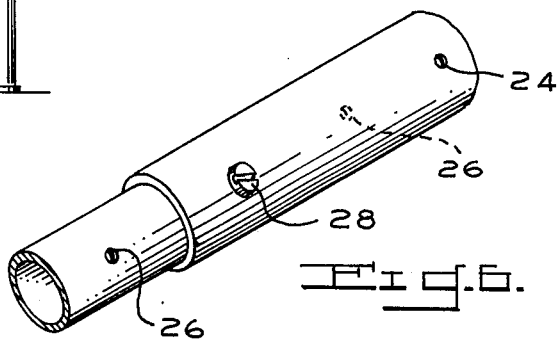
Fig. 6.

MOTOR VEHICLE HOUSING

BACKGROUND OF THE INVENTION

The present invention relates generally to a shelter, housing or self-supporting cover for protecting a motor vehicle. More particularly, the invention relates to an automobile housing in the form of a partial car port easily erectable to protect all or certain sections of an automobile from weather conditions.

Automobiles which are exposed to the weather deteriorate much more rapidly than automobiles that are housed in a garage. Further, in cold weather, cars which are not garaged are often more difficult to start and sometimes become covered with snow, which is strenuous and annoying to remove.

While vehicle covers have been developed to protect portions of an automobile from the elements, none of the products available are adjustable to accommodate different size automobiles. Such products are disclosed in U.S. Pat. No. 2,113,294 to Dotten, U.S. Pat. No. 2,698,629 to Hall and U.S. Pat. No. 1,061,547 to Kennedy et al.

SUMMARY OF THE INVENTION

The present invention is an automobile cover or housing which is adjustable in size to accommodate therein portions of various size automobiles.

Briefly stated, the invention comprises a partial car port or housing having a tubular frame with interfitting sections that can be telescoped relative to one another to expand or contract the size of the frame.

In the preferred embodiment, the frame includes a generally horizontal portion variable in size to approximate the horizontal dimensions of any particular automobile hood. The frame further includes a plurality of vertical support legs that are attached to the frame. The legs can be adjustably lengthened or shortened to raise or lower the horizontal portion to accommodate car hoods of different height.

In another embodiment, the automobile housing includes a windshield cover portion. This alternate embodiment includes a windshield cover frame pivotally extending from a base support structure which may be the frame of a hood housing or some separate structure.

Accordingly, the principal object of this invention is to provide an improved automobile housing which has a frame that can be easily adjusted in size to closely fit over portions of an automobile.

Another object of this invention is to provide an automobile housing of the above type which, while being of simple and economical construction, is sturdy and effective to use.

The above and other objects and advantages of this invention will become more readily apparent from the following description taken in conjunction with the accompanying drawings.

BRIEF DESCRIPTION OF THE DRAWINGS

FIG. 1 is a perspective view of an automobile hood housing constructed in accordance with the present invention;

FIG. 2 is a perspective view of an adjustable frame for the FIG. 1 housing;

FIG. 3 is an end view of the FIG. 2 frame;

FIG. 4 is an end view of the adjustable frame for a windshield housing constructed in accordance with the present invention;

FIG. 5 is a fragmentary side view of an adjustable windshield cover frame used in combination with an adjustable hood housing frame; and FIG. 6 is an enlarged, fragmentary view of a telescopic section of the FIG. 2 frame.

DETAILED DESCRIPTION OF THE PREFERRED EMBODIMENTS

Referring to the drawings, an automobile hood housing is shown in FIGS. 1–3 and generally designated by the reference numeral 10. The housing 10 includes a sheet material such as plastic or canvas carried on a frame 14 which is adjustable in height, length and width. By adjusting the dimensions of the frame, the housing 10 can be adapted to closely fit over the hood of most motor vehicles, including cars, such as the representative car 15 in FIG. 1, and pickup trucks (not shown). The close-fitting housing 10 protects and shelters the vehicle's hood and engine from adverse weather conditions much in the manner of a permanent car port structure.

As best shown in FIG. 2, the adjustable frame 14 includes a substantially rectangular, horizontal portion 16 and a plurality of spaced support legs 18 that extend vertically from the portion 16. The portion 16 has four tubular corner brackets 20, one at each corner of the frame. A tubular member or bar 22 on each side of the frame is slidably fitted into the opposed open ends of adjacent corner brackets 20. The brackets 20 and side bars 22, respectively, have a plurality of axially-spaced holes 24, 26. Each bracket 20 is fixedly connected to its telescopically received bar 22 by insertion of a suitable fastening device, e.g., a pin or bolt 28, through a hole 24 and an aligned hole 26. By varying which hole 24 is aligned with a particular hole 26, the telescopic sections of the tubes 20 and side bars 22 can be extended or contracted to vary the length or width of the horizontally-extending portion 16 of FIG. 2 (see FIG. 3).

A support leg 18 is connected to each corner bracket 20 by any suitable means such as by welding or the like. A plurality of gussets 32 are welded to each leg and associated bar 20 to reinforce the frame structure. As best shown in FIG. 2, the legs each comprise outer tubular members 34 interconnected by an intermediate tubular bar 36 which is telescopically received within opposed ends of tubular members 34. Similar to sides of the frame portion 16, the legs are adjustable in length by use of holes 38, 40 through which fastening devices, e.g., pins or bolts 42, are inserted. By selecting different combinations of aligned holes, the telescopic legs 18 can be extended or contracted to raise or lower the height of the frame 14 (see FIG. 3).

The canvas 12 is sufficient in size so that it will cover the frame 14 even when the frame is in its most expanded position. The canvas is attached to the frame by any suitable means, e.g., flaps with VELCRO strips (not shown), and is adjustable in size by any suitable means, e.g., rows of VELCRO strips on its sides (not shown), to conform to the dimensions of the frame 14 after the frame has been expanded or contracted.

Referring to FIG. 4, an adjustable frame for a windshield cover is shown and generally designated by the reference numeral 43. The frame is adjustable in length, height and width to conform to different-sized windshields and is comprised of a rectangular portion 44 and spaced support legs 46.

The rectangular portion 44 includes a horizontal outer tubular member 47, two transverse members 48 and four tubular corner brackets 50, 52, 54, 56. The tubular members 47 and 48 are telescopically interfitted with the opposed ends of the corner brackets 50 and 52, while the lower ends of brackets 54 and 56 are pivotally received within two L-shaped, outer tubes 58 of the legs 46.

The tubular members 47, 48 and the corner brackets 50, 52, 54, 56 each include a plurality of spaced holes with suitable fastening devices in aligned holes (which have not been illustrated for the sake of simplicity).

The support legs 46 each comprise an upper, L-shaped tube 58 and a lower, straight tube 60. The upper and lower inner bar and outer tubes 58, 60 are interconnected by an inner tubular member or bar (not shown) that is telescopically received within opposed open ends of the tubes. The inner bar and outer tubes 58, 60 have a plurality of alignable holes and fastening devices (not shown) for raising and lowering of legs 46 in a similar manner to that previously described for legs 18 and shown in FIG. 3.

Alternatively, the windshield cover frame 43 can be a self-contained unit (as illustrated in FIG. 4) or a secondary portion connected to the hood cover frame 14 of FIG. 2 (see FIG. 5). The secondary portion is, in effect, the frame 43 without the support legs 46. Instead of the bars 54, 56 being received in the L-shaped tubes of the legs 46, the bars 54, 56 are received within a pair of tubular members 62 that are each connected to a corner bracket 20. In that combination, the modified portion 44 is, in effect, a second rectangular portion of the frame 14.

It should be understood that obvious structural modifications of the disclosed embodiments can be made without departing from the spirit of the invention. Accordingly, reference should be made primarily to the accompanying claims rather than to the specification to determine the scope of the invention.

Having thus described the invention, what is claimed is:

1. An automobile housing comprising:

(a) a frame including:

(i) a generally horizontal portion defined, at least in part, by telescopically adjustable tubular members for varying the perimeter thereof to conform to horizontal dimensions of an automobile;

(ii) a plurality of upright support members extending from said horizontal portion and including a plurality of telescopic sections adapted to be varied in length to adjust the height of said frame; and (iii) a substantially rectangular portion pivotally connected to said horizontal portion, said second portion being defined, at least in part, by telescopically adjustable tubular members for varying the perimeter of the second portion to conform to the dimensions of an automobile windshield; and (b) flexible covering adapted to be supported over said frame to form therewith a windshield cover and an enclosed housing about at least the hood portion of an automobile.

2. The hood cover of claim 1 wherein said horizontal portion is substantially rectangular.

3. A frame for an automobile cover comprising:

(a) a generally horizontal first portion with telescopic means for varying the perimeter thereof to conform to the horizontal dimensions of an automobile hood;

(b) a plurality of upright support legs extending from said first portion and including second telescopic means to vary the length of said legs to adjust the height of the frame; and (c) a second portion connected to said first portion, said second portion having third telescopic means to vary the perimeter thereof to conform to the perimeter of an automobile windshield.

4. The frame of claim 3 wherein said second portion is pivotally connected to said first portion.

5. The frame of claim 4 wherein said first and second portions are substantially rectangular.

* * * * *